US009960473B2

(12) United States Patent
Katz et al.

(10) Patent No.: US 9,960,473 B2
(45) Date of Patent: May 1, 2018

(54) INTEGRATED DIFFERENTIAL PHASE SHIFTER BASED ON COUPLED WIRE COUPLER USING A DIAGONAL CONFIGURATION

(71) Applicant: International Business Machines Corporation, Armonk, NY (US)

(72) Inventors: Oded Katz, Ganei-Tikva (IL); Nadav Mazor, Givatayim (IL)

(73) Assignee: International Business Machines Corporation, Armonk, NY (US)

( * ) Notice: Subject to any disclaimer, the term of this patent is extended or adjusted under 35 U.S.C. 154(b) by 153 days.

(21) Appl. No.: 14/952,941

(22) Filed: Nov. 26, 2015

(65) Prior Publication Data

US 2017/0155181 A1 Jun. 1, 2017

(51) Int. Cl.
*H01P 1/18* (2006.01)
*H01P 5/18* (2006.01)

(52) U.S. Cl.
CPC ..... *H01P 5/18* (2013.01)

(58) Field of Classification Search
CPC H03F 3/68; H03F 3/602; H03D 3/007; H01P 9/00; H01P 1/184; H01P 5/18; H01P 5/186
USPC ..... 333/156, 116, 117
See application file for complete search history.

(56) References Cited

U.S. PATENT DOCUMENTS 7,386,291 B2 6/2008 Floyd et al.
8,760,240 B2 6/2014 Yehezkely
8,947,160 B2 2/2015 Ding et al.

FOREIGN PATENT DOCUMENTS

WO 2010076085 7/2010
WO 2013102964 7/2013

OTHER PUBLICATIONS

Juan José Sánchez Martínez., "Analysis and Design of Enhanced Planar Devices Using Multiconductor Transmission Lines With Interconnected Alternate Lines", Publicaciones y Divulgación Cientifica. Universidad de Málaga, 2014.

Yunliang Zhu and Hui Wu., "A 10-40 GHz 7 dB Directional Coupler in Digital CMOS Technology", Laboratory for Advanced Integrated Circuits and Systems, Department of Electrical and Computer Engineering University of Rochester, Rochester, NY 14627, 2006.

*Primary Examiner* — Robert J Pascal
*Assistant Examiner* — Kimberly Glenn
(74) *Attorney, Agent, or Firm* — Barry Blount

(57) ABSTRACT

A system comprises a differential phase shifter based on a differential coupled line coupler that can include a ground metal layer, a bottom metal layer and a top metal layer. The differential line coupler can include differential input lines comprising two metal stack layers (top and bottom), which are arranged diagonally, and the differential output lines are arranged in a complementary diagonal configuration. This layout configuration overcomes the asymmetry caused by the difference in metal layer thickness and width difference, as well as a periphery effect such as the distance to a ground plane or substrate. The proposed diagonal layout configuration balances the characteristic impedance and phase accumulation on each coupled wire of the differential coupled line coupler, which improves the performance of the phase shifter, e.g. lower insertion loss and wider phase tuning range.

20 Claims, 9 Drawing Sheets

600

700

INTEGRATED DIFFERENTIAL PHASE SHIFTER BASED ON COUPLED WIRE COUPLER USING A DIAGONAL CONFIGURATION

BACKGROUND

The present disclosure relates to phase shifters, and more specifically, but not exclusively, to phase shifters comprising differential line couplers.

SUMMARY

According to an embodiment described herein, a system for shifting electric signals can include a differential coupled line coupler comprising a ground metal layer, a top metal layer comprising a positive input line and a positive output line, and a bottom metal layer comprising a negative output line and a negative input line. In some examples, the negative output line and the negative input line are to be located in the coupler in a diagonal configuration in which the positive input line resides atop the negative output line and the positive output line resides atop the negative input line, wherein the input lines comprise metal lines with an input port on a first side and a through port on a second side, and wherein the output lines comprise metal lines with a coupled port on a first side and an output port on a second side. Additionally, the input lines can be connected to a through differential load, and the output lines can be connected to a coupled differential load, wherein the through differential load and the coupled differential load each comprise an inductor, a capacitor, a transmission line, a resistor, or any combination thereof, and wherein an electric signal phase of the output lines in relation to an electric signal phase of the input lines is to be shifted.

According to another embodiment, a method for phase shift of an electric signal can include differentially transmitting an electric signal to a positive input line and a negative input line, wherein the positive input line and the negative input line reside in a diagonal configuration in different metal layers of a differential line coupler. The method can also include setting variable loads to perform a predetermined phase shift of the electric signal and outputting a resulting electric signal from a positive output line and a negative output line, wherein the positive output line and the negative output line reside in a diagonal configuration in different layers of the line coupler.

According to another embodiment a system for shifting electric signals can include a ground metal layer, the ground metal layer to be a solid plane or a striped plane, a top metal layer comprising a positive input line and a positive output line, and a bottom metal layer comprising a negative output line and a negative input line. In some examples, the negative output line and the negative input line are to be located in the coupler in a diagonal configuration in which the positive input line resides atop the negative output line and the positive output line resides atop the negative input line. Additionally, the system includes at least two differential loads connected to the input line through port and the output line coupled port, and can be comprised of an inductor, a capacitor, a transmission line, a resistor, or any combination thereof, and wherein an electric signal phase of the output lines in relation to an electric signal phase of the input lines is to be shifted.

DETAILED DESCRIPTION

Figure 1:
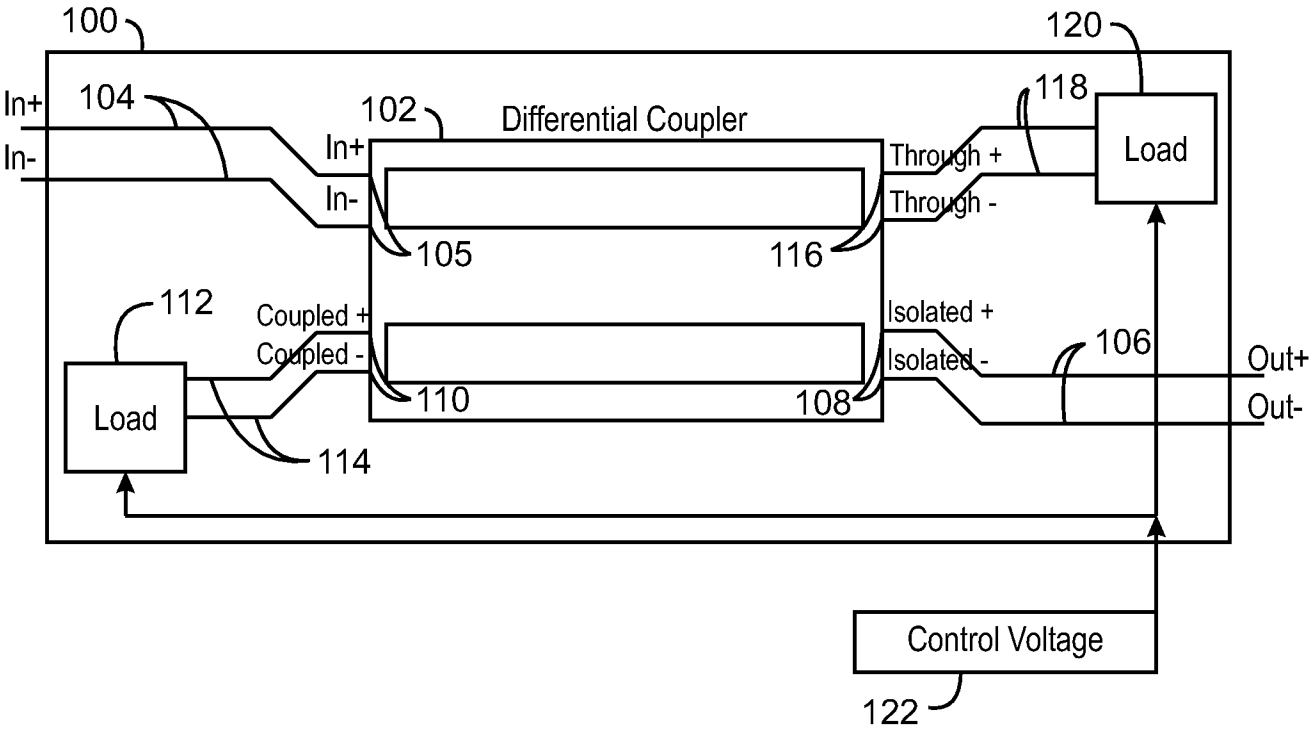
FIG. 1 depicts a block diagram of a differential phase shifter according to an embodiment described herein.

Embodiments of the present invention include differential phase shifters with line couplers, as shown in FIG. 1, that enable a phase shift of electric signals. Differential phase shifters can enable a voltage controllable phase shift of electric signals, for example at any suitable radio frequency. However, differential phase shifters that include line couplers can lack symmetry between input and output lines, which can negatively impact the performance of the phase shifter.

Figure 2A:
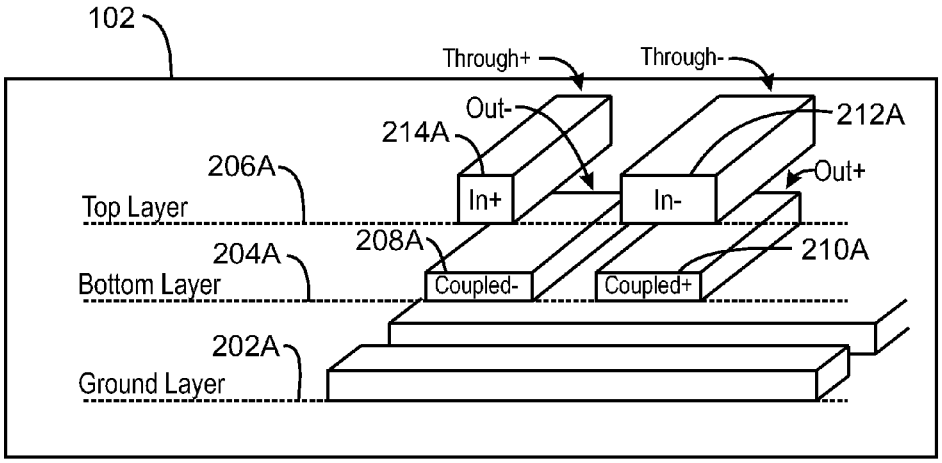
PRIOR ART FIG. 2A
FIG. 2A depicts a side view of layers of a differential coupled line coupler according to a prior-art conventional implementation.

Current techniques for shifting signals, such as the technique shown in FIG. 2A, include a differential coupled line coupler, where the differential input lines are fabricated at one (top) metal layer and the differential output lines are implemented at a second (bottom) metal layer. Since the top and bottom metals have different thickness and different width due to technology fabrication limitations, there is a difference in the characteristic impedance and in phase accumulation of the coupled lines. This constraint on the fabrication of coupled line coupler may force the design of a complex load on the coupled and through terminals to compensate for the imbalanced line, which in-turn will cause an increase in the phase shifter loss and degradation in its performance.

Figure 2B:
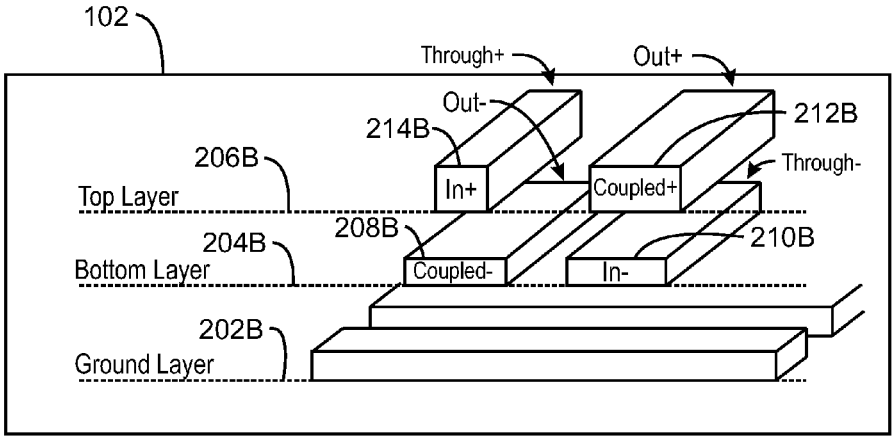
FIG. 2B depicts a side view of layers of a differential coupled line coupler with a diagonal configuration according to an embodiment described herein.

The embodiments described herein include a differential phase shifter that includes a line coupler that has a ground metal layer, a bottom metal layer, and a top metal layer. In some embodiments, the top layer can include a positive input line and a positive output line. The bottom layer can include a negative input line and a negative output line arranged so that the output lines in the bottom layer and top layer are diagonal to one another. Embodiments described herein employ a diagonal configuration which balances the characteristic impedance and phase accumulation on each coupled wire pair of the differential coupled line coupler, as shown in FIG. 2B. Thus, the differential phase shifter of the present claims can present a phase shifter with lower loss and a simpler balanced load.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

FIG. 1 depicts a block diagram of a phase shifter according to an embodiment described herein. The phase shifter 100 includes a line coupler 102 (also referred to herein as a differential line coupler), with an input port 104 (which includes two differential terminals input + and input −) connected to the line coupler input port 105, and an output port 106 (which includes two differential terminals output + and output −) connected to the line coupler isolated port 108 (which includes two differential terminals isolated + and isolated −). The differential line coupler coupled port 110 (which includes two differential terminals 114 coupled + and coupled −) is connected to a first differential load 112, and differential line coupler through port 116 (which includes two differential terminals 118 through + and through −) is connected to a second differential load 120. A terminal, as referred to herein, includes the end of a line, and for differential topology specific ports, as denoted to herein, refers to a pair of terminals, the end of two lines or differential lines. In some embodiments, the input port 104 can receive and the output port 106 can transmit electric signal at a radio frequency or any other suitable frequency. In some embodiments, the first differential load 112 and the second differential load 120 can include a capacitor, an inductor, a resistor, a transmission line or any combination thereof. The differential first load 112 and the second differential load 120 are variable loads that can be electronically or mechanically controlled. The phase shifter 100 also includes a control 122 that can provide a control voltage to the first load 112 and the second load 120, such that the first load and the second load values will vary. In some examples, the first load 112 and the second load 120 provide the same load to the coupled line 110 and the through port 116. The loads from the first load 112 and the second load 120 are reflective reactive or resistive loads, and they reflect the signals to the coupler with a certain phase shift as the load value is being varied by the control voltage 122, which results in the reflected signal phase shift. At the isolated port 108 and output port 106, the reflected signals are superimposed and create the output transmitted signal, whereas the phase of the output signal depends on the controlled first differential load 112 and the second differential load 120. The isolated port 108 and output port 106 transmit a radio frequency signal with a phase that has been shifted any suitable amount compared to the input port phase.

FIG. 2A depicts a side view of metal layers for a conventional coupled line coupler designed for a phase shifter as presented in a prior-art. The coupler 102 includes a ground metal layer 202A, a bottom metal layer 204A, and a top metal layer 206A. The ground layer 202A can have any suitable horizontal electrically conductive surface shape. In some embodiments, the ground layer 202A is a full metal plate under the coupler structure. In some examples of a conventional coupled line coupler, the positive input line 214A resides atop the negative output line 208A (corresponding to the coupled− line) and the negative input line 212A resides atop the positive output line 210A (corresponding to the coupled+ line) as shown in FIG. 2A. In other examples of a conventional coupled line coupler, the positive input line 214A resides atop the negative input line 212A and the negative output line 208A resides atop the positive output line 210A.

FIG. 2B depicts a side view of layers of a coupled line coupler with a diagonal configuration designed for a phase shifter according to an embodiment described herein. The coupled line coupler can include a ground layer 202B, bottom layer 204B, and top layer 206B. In some embodiments, the bottom layer 204B of the coupler 102 can include a negative output line 208B and a negative input line 210B. The negative output line 208B and the negative input line 210B of the bottom layer 204 can be arranged in a diagonal configuration with the lines of the top layer 206B. For example, the top layer 206B can include a positive output line 212B and a positive input line 214B, wherein the positive output line and the positive input line are placed in a diagonal configuration such that the positive input line resides atop the negative output line and the positive output line resides atop the negative input line.

In some embodiments, the ground layer 202B can be any suitable horizontal electrically conductive surface. In some embodiments, the ground layer 202B is parallel to the bottom layer 204B and top layer 206B while the ground layer stripes are vertical to the flow direction. The ground layer 202B can be either a solid plane or a striped plane. A striped plane can result in shorter coupler line lengths, which reduces the die area of the entire phase shifter 100. In some embodiments, the phase shifter 100 can utilize a smaller die area and can be implemented into integrated circuit technologies. In some examples, the ground layer 202B can be connected to an electrical ground.

In some embodiments, the top metal layer 206B comprises a first material and the bottom metal layer 204B comprises a second material, wherein the first material has a lower resistance than the second material. In some examples, the top metal layer 206B comprises aluminum or copper and the bottom metal layer 204B comprises aluminum or copper and the top metal layer has a thickness greater than the bottom metal layer. In some embodiments, the thickness and width of the top metal 206B and the bottom metal 204B can be different, thus creating asymmetry between the top and bottom lines.

The phase shifter 100, with the differential coupled line coupler diagonal configuration 102, overcomes the asymmetry caused by the difference in metal layer thickness and width difference, as well as periphery effect such as the distance to a ground plane or substrate. This diagonal configuration balances the characteristic impedance and phase accumulation on each coupled wire of the differential coupled line coupler. Thus, the phase shifter 100, with the differential coupled line coupler diagonal configuration 102, has an improved performance, a reduced insertion loss and wider phase tuning range.

In some embodiments, a first differential load can be located between a positive through in the top layer 206B and a negative through in the bottom layer 204B (also referred to herein as the through port). Similarly, a second load can be located between a positive coupled in the top layer 206B and a negative coupled in the bottom layer 204 (also referred to herein as the coupled port).

Figure 3:
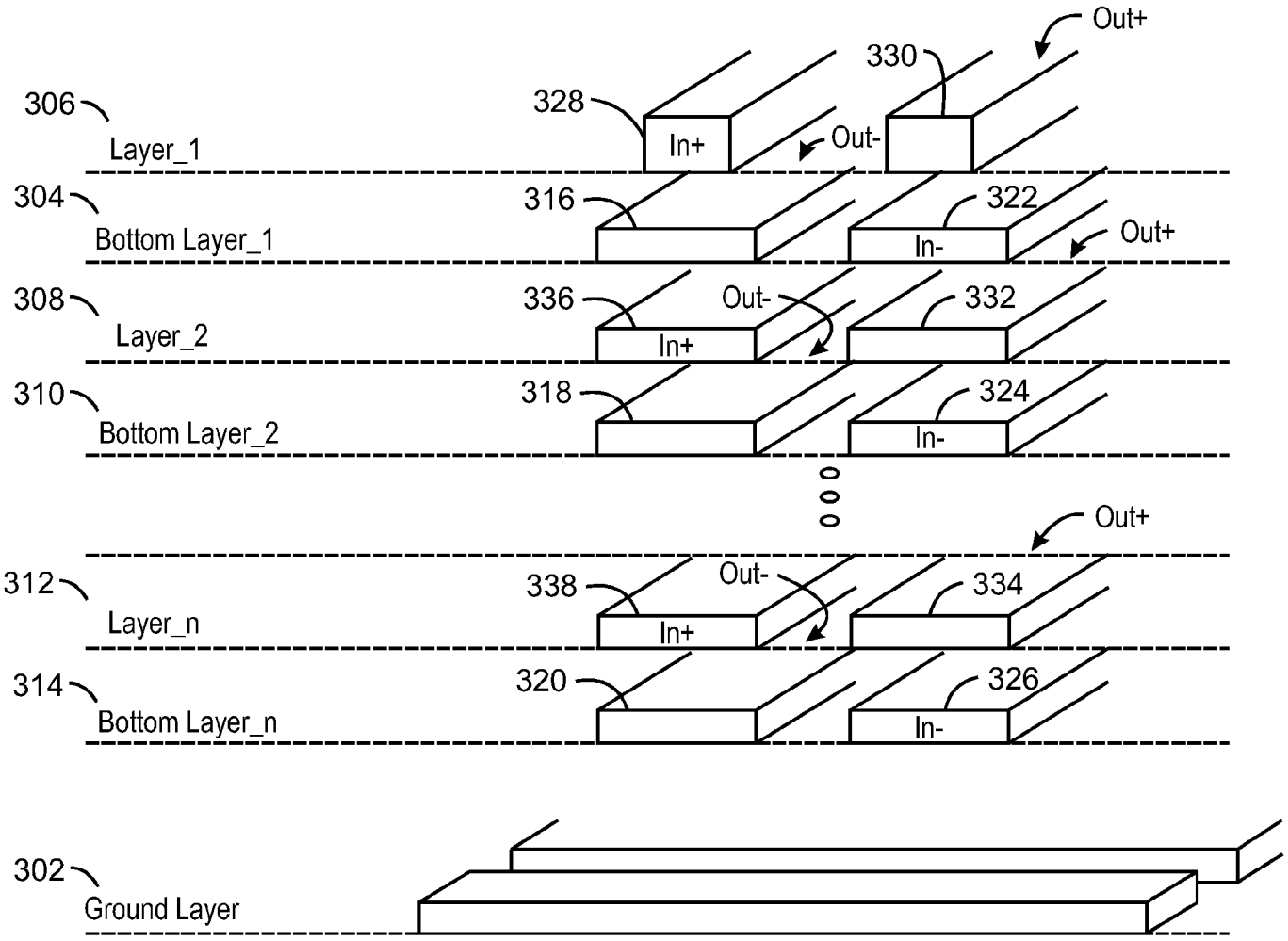
FIG. 3 depicts a side view of layers of a differential coupled line coupler with a vertical stacked diagonal configuration according to an embodiment described herein.

FIG. 3 depicts a side view of layers of a coupler according to an embodiment described herein. FIG. 3 depicts multiple metal layers of a vertically stacked differential coupled line coupler 300 in a phase shifter 100, in which any suitable number of diagonally placed input lines and output lines can be stacked above a ground layer. Input lines refer to a pair of metal lines with an input port on one side (positive input terminal and negative input terminal) and through port on the other side (positive through terminal and negative through terminal). Output lines refer to a pair of metal lines with an output port on one side (positive output terminal and negative output terminal) and coupled port on the other side (positive coupled terminal and coupled through terminal). For example, coupler 300 can include a ground layer 302, a bottom layer 1 304, and a top layer 1 306. In some embodiments, the coupler 300 can include any number of bottom layers and top layers such as top layer 2 308, bottom layer 2 310 through top layer N 312 and bottom layer N 314. In some embodiments, each of the bottom layers 304, 310, and 314 of the coupler 300 can each include a negative output line 316, 318, and 320 and a negative input line 322, 324, and 326. In some examples, the negative output line and the negative input line of each of the bottom layers 304, 310, and 314 can be arranged in a diagonal configuration with the lines of a corresponding top layer 306, 308, or 312. For example, the top layer 306 can include a positive input line 328 and a positive output line 330, wherein the positive output line and the positive input line are located in a diagonal configuration such that the positive input line 328 resides atop the negative output line 316 and the positive output line 330 resides atop the negative input line 322. Each top layer 308 through 312 can include positive output lines 332 and 334 and positive input lines 336 and 338 that are arranged similarly.

In some embodiments, a first load can be located between each of the inputs lines, thus the first load can be connected between all of the positive through terminals such as 328, 336, and 338, in top layer 1 to top layer N, and all of the negative through terminals input lines, such as 322, 324, and 326 in bottom layer 1 to bottom layer N. Therefore, the first load shorts all of the positive through terminals together and shorts all of the negative through terminals together. Similarly, a second load can be located between each of the output lines, thus the second load can be connected between all of the positive coupled terminals such as 330, 332, and 334 in top layer 1 to top layer N, and all of the negative coupled terminals output lines, such as 316, 318, and 320 in bottom layer 1 to bottom layer N. Therefore, the second load shorts all of the positive coupled terminals together and shorts all of the coupled through terminals together.

In some embodiments, there are multiple loads connected to the differential line coupler. For example, there can be a set of N (number) through loads. Each of the through loads can be connected separately to a pair of input lines. Each through load can be located between each of the input lines. Thus, a first through load can be connected between the positive through terminal 328 in top layer 1, and the negative through terminal 322 in bottom layer 1. The through load N can be connected between the positive through terminal 338 in top layer N, and the negative through terminal 326 in bottom layer N. Similarly, each coupled load can be located between each of the output lines. Thus, coupled load 1 can be connected between the positive coupled terminal 330 in top layer 1, and the negative coupled terminal 316 in bottom layer 1. The coupled load N can be connected between the positive coupled terminal 334 in top layer N, and the negative coupled terminal 320 in bottom layer N. The through loads can have either the same or different control voltages for each load. The coupled loads can also have either the same or different control voltages for each load.

Furthermore, the ground layer 302 can be any suitable horizontal electrically conductive surface. In some embodiments, the ground layer 302 is parallel to the bottom layer N 314 and top layer N 312 while the ground layer stripes are vertical to the flow direction. The ground layer 302 can be either a solid plane or a striped plane. A striped plane can result in shorter coupler line lengths, which reduces the die area of the phase shifter 300. In some examples, the ground layer 302 can be connected to an electrical ground.

Figure 4:
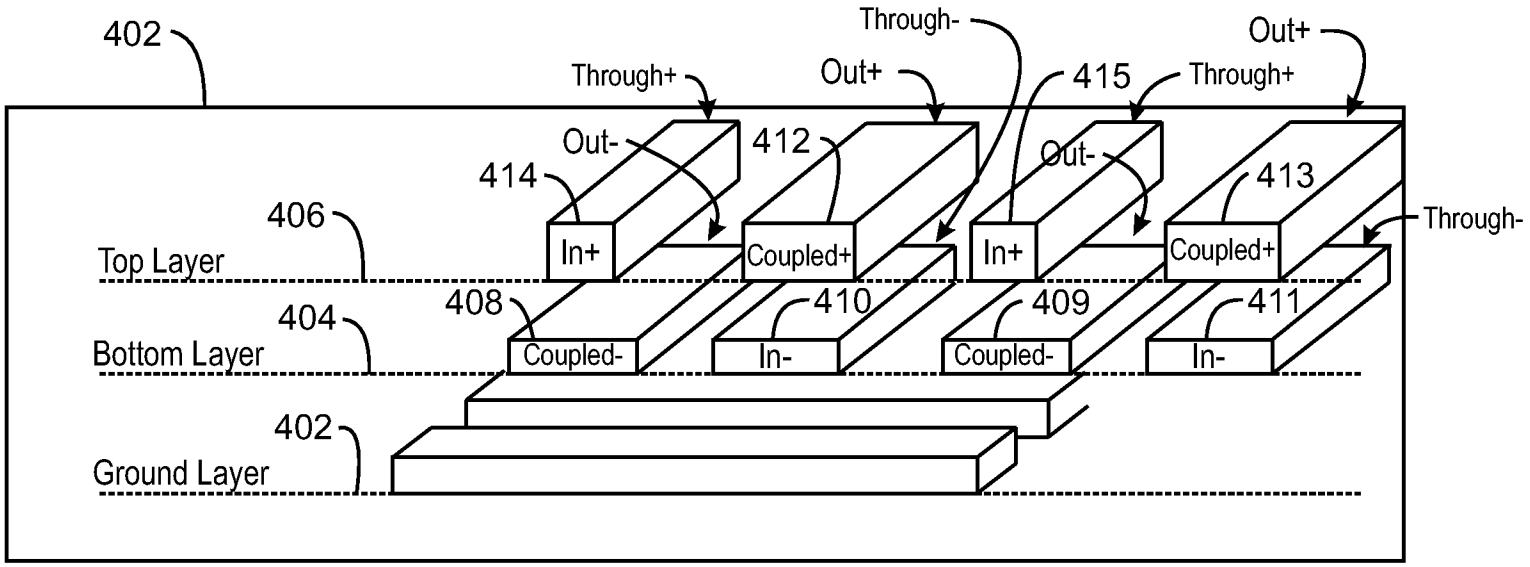
FIG. 4 depicts a side view of layers of a differential coupled line coupler with a lateral stacked diagonal configuration according to an embodiment described herein.

FIG. 4 depicts a side view of layers of a differential coupled line coupler with a lateral stacked diagonal configuration according to an embodiment described herein. In some embodiments, the coupler comprises a ground layer 402, a bottom layer 404, and a top layer 406. The ground layer 402 can be any suitable horizontal electrically conductive surface. In some embodiments, the ground layer 402 is parallel to the bottom layer 404 and top layer 406 while the bottom layer stripes are vertical to the flow direction. The ground layer 402 can be either a solid plane or a striped plane. A striped plane can result in shorter coupler line lengths, which reduces the die area of the phase shifter 400. In some examples, the ground layer 402 can be connected to an electrical ground.

In some embodiments, the bottom layer 404 of the coupler 402 can include any suitable number of negative output lines 408 and 409 and negative input line 410 and 411. In some examples, the negative output lines 410 and 409 and the negative input lines 410 and 411 of the bottom layer 404 can be arranged in a diagonal relationship with the lines of the top layer 406. For example, the top layer 406 can include any suitable number of positive output lines such as 412 and 413 and positive input lines such as 414 and 415, wherein the positive output line and the positive input line are located in a diagonal configuration such that each positive input line resides atop a negative output line and each positive output line resides atop a negative input line. In some embodiments, the bottom layer 404 and the top layer 406 can include any suitable number of output lines and input lines arranged in a diagonal placement. In some embodiments, the phase shifter 400 can utilize a smaller die area and can be implemented into integrated circuit technologies.

Input lines refer to a pair of metal lines with an input port on one side (positive input terminal and negative input terminal) and a through port on the other side (positive through terminal and negative through terminal). Output lines refer to a pair of metal lines with an output port on one side (positive output terminal and negative output terminal) and a coupled port on the other side (positive coupled terminal and coupled through terminal). In some embodiments, a first load can be located between each of the inputs lines, thus the first load can be connected between all of the positive through terminals such as 414 and 415, in top layer 406, and all of the negative through terminals input lines, such as 410 and 411 in bottom layer 404. Therefore, the first load shorts all of the positive through terminals together and shorts all of the negative through terminals together. Similarly, a second load can be located between each of the output lines, thus the second load is connected between all of the positive coupled terminals such as 412 and 413 in top layer 406, and all the negative coupled terminals output lines, such as 408 and 409 in bottom layer 404. Therefore, the second load shorts all of the positive coupled terminals together and shorts all of the coupled through terminals together.

In some embodiments, there are multiple loads connected to the line coupler. There is a set of N (number) through loads. Each of the through loads can be connected separately to a pair of input lines. Each through load can be located between each of the input lines. Thus, through load 1 can be connected between the positive through terminal 414 in top layer 406, and the negative through terminal 410 in bottom layer 404. The through load 2 can be connected between the positive through terminal 415 in top layer 406, and the negative through terminal 411 in bottom layer 404. Similarly, each coupled load can be located between each of the output lines. Thus, coupled load 1 can be connected between the positive coupled terminal 412 in top layer 406, and the negative coupled terminal 408 in bottom layer 404. The coupled load 2 can be connected between the positive coupled terminal 413 in top layer 406, and the negative coupled terminal 409 in bottom layer 404. The through loads can have either the same or different control voltages for each load. The coupled loads can also have either the same or different control voltages for each load.

In FIG. 4, there are 2 sets of input lines and output lines laterally stacked, but a more general case will include N sets of sets of input lines and output lines laterally stacked.

Figure 5:
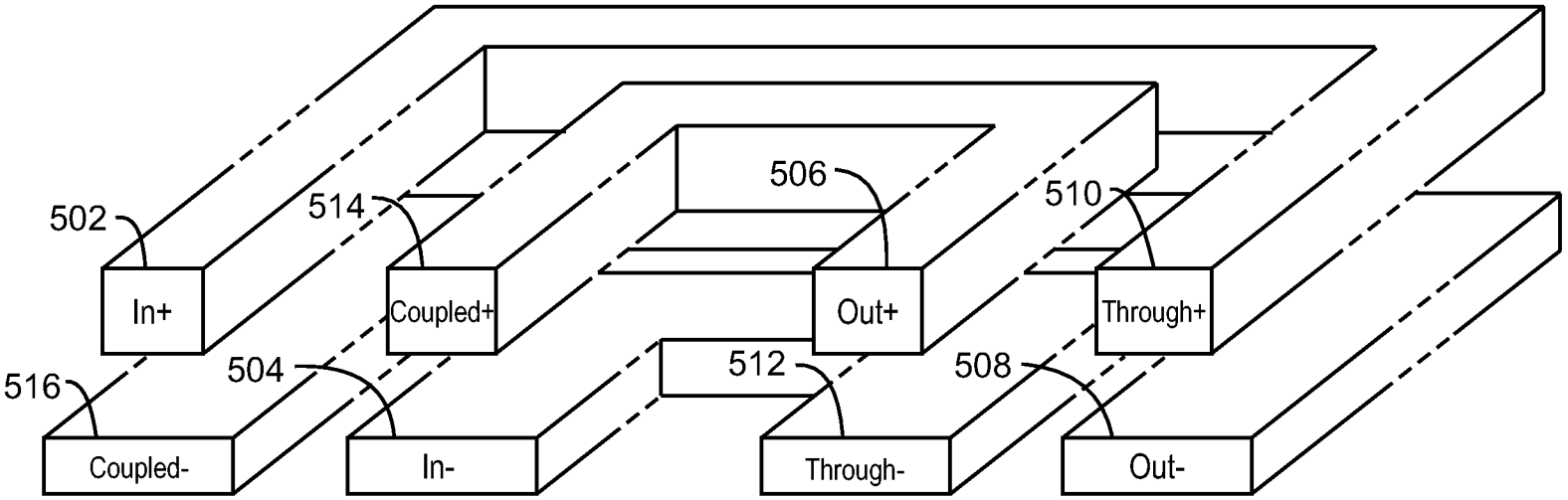
FIG. 5 depicts a side view of layers of a differential coupled line coupler with a lateral folded diagonal configuration according to an embodiment described herein.

FIG. 5 depicts a side view of layers of a differential coupled line coupler with a lateral folded diagonal configuration. The differential input lines 502 and 504 and differential output lines 506 and 508 are folded laterally, such that the input port and the through port 510 and 512 of the input lines can be on the same side, and the output port and the coupled port 514 and 516 of the output lines can be on the same side.

Figure 6:
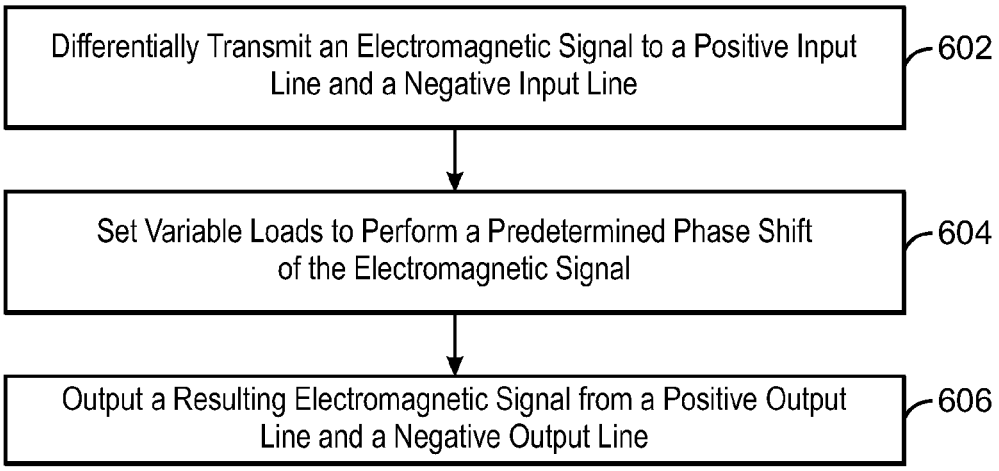
FIG. 6 is a process flow diagram for transmitting a signal using a phase shifter according to an embodiment described herein.

FIG. 6 is a process flow diagram for transmitting a signal using a phase shifter according to an embodiment described herein.

At block 602, a phase shifter can differentially transmit an electromagnetic signal to a positive input line and a negative input line, wherein the positive input line and the negative input line reside in a diagonal configuration in different layers. In some embodiments, the electromagnetic signal can include any suitable radio wave signal, among others. In some embodiments, the negative output line and the positive output line can be located in the coupler in a diagonal configuration in which the positive input line resides atop the negative output line and the positive output line resides atop the negative input line.

At block 604, a phase shifter can set variable loads to perform a predetermined phase shift of the electromagnetic signal. In some embodiments, the variable loads are set by an external control, which can be any suitable control changing the load provided to the phase shifter. The external control can change properties of a capacitor, a resistor, an inductor, a transmission line, or any combination thereof which represent the load. In some embodiments, the electromagnetic signal can obtain a phase shift corresponding to any suitable phase shift variation or swing.

At block 606, the phase shifter can output a resulting electromagnetic signal from a positive output line and a negative output line, wherein the positive output line and the negative output line reside in a diagonal configuration in different layers. In some embodiments, the phase shifter can shift millimeter waves in frequencies above 30 GHz, or any other suitable frequency. In some embodiments, the phase shifter or a line coupler within the phase shifter can vary phase differentiation.

The process flow diagram of FIG. 6 is not intended to indicate that the operations of the method 600 are to be executed in any particular order, or that all of the operations of the method 600 are to be included in every case. Additionally, the method 300 can include any suitable number of additional operations.

Figure 7:
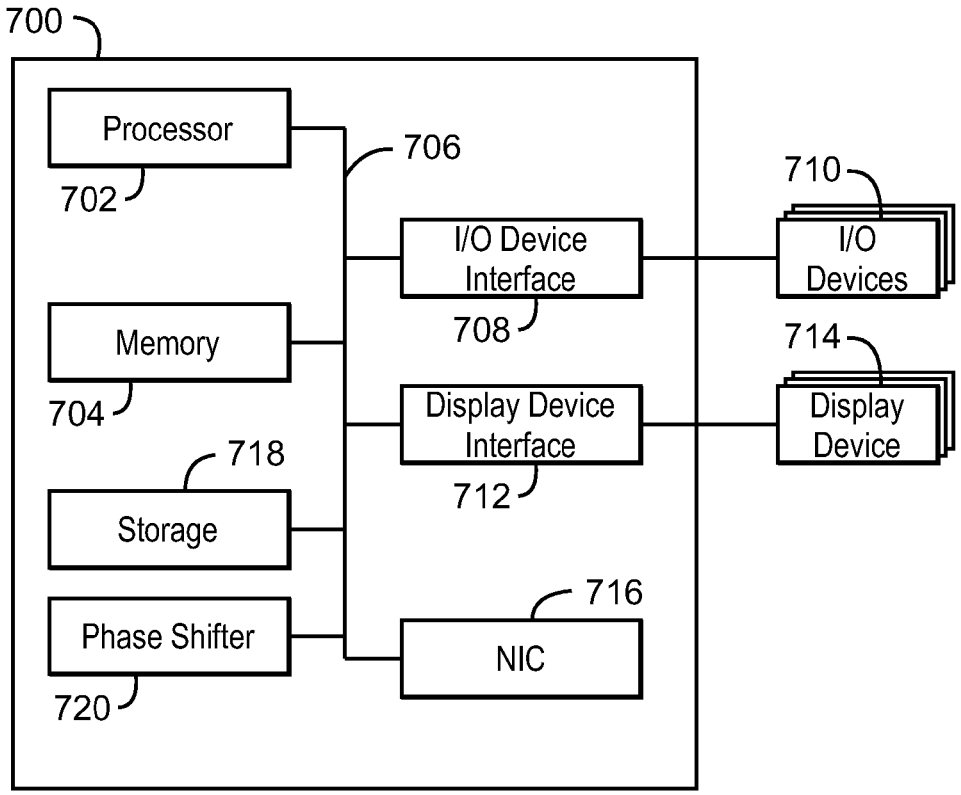
FIG. 7 is a block diagram of an example computing device that includes a phase shifter.

FIG. 7 is a block diagram of an example computing device that includes a phase shifter. The computing device 700 may control the variable load and sample the output to achieve the desired phase shift. In some embodiments, the computing device 700 may be for example, a server, desktop computer, laptop computer, tablet computer, or smartphone. In some examples, computing device 700 may be a cloud computing node. Computing device 700 may be described in the general context of computer system executable instructions, such as program modules, being executed by a computer system. Generally, program modules may include routines, programs, objects, components, logic, data structures, and so on that perform particular tasks or implement particular abstract data types. Computing device 700 may be practiced in distributed cloud computing environments where tasks are performed by remote processing devices that are linked through a communications network. In a distributed cloud computing environment, program modules may be located in both local and remote computer system storage media including memory storage devices.

The computing device 700 may include a processor 702 that is adapted to execute stored instructions, a memory device 704 to provide temporary memory space for operations of said instructions during operation. The processor can be a single-core processor, multi-core processor, computing cluster, or any number of other configurations. The memory 704 can include random access memory (RAM), read only memory, flash memory, or any other suitable memory systems.

The processor 702 may be connected through a system interconnect 706 (e.g., PCI®, PCI-Express®, etc.) to an input/output (I/O) device interface 708 adapted to connect the computing device 700 to one or more I/O devices 710. The I/O devices 710 may include, for example, a keyboard and a pointing device, wherein the pointing device may include a touchpad or a touchscreen, among others. The I/O devices 710 may be built-in components of the computing device 700, or may be devices that are externally connected to the computing device 700.

The processor 702 may also be linked through the system interconnect 706 to a display interface 712 adapted to connect the computing device 700 to a display device 714. The display device 714 may include a display screen that is a built-in component of the computing device 700. The display device 714 may also include a computer monitor, television, or projector, among others, that is externally connected to the computing device 700. In addition, a network interface controller (NIC) 716 may be adapted to connect the computing device 700 through the system interconnect 706 to a network (not depicted). In some embodiments, the NIC 716 can transmit data using any suitable interface or protocol, such as the internet small computer system interface, among others. The network may be a cellular network, a radio network, a wide area network (WAN), a local area network (LAN), or the Internet, among others.

The processor 702 may also be linked through the system interconnect 706 to a storage device 718 that can include a hard drive, an optical drive, a USB flash drive, an array of drives, or any combinations thereof. In some embodiments, the processor 702 can also be linked through the system interconnect 706 to a phase shifter 720. The phase shifter 720 can include a line coupler that can include a ground metal layer, a top metal layer comprising a positive input line and a positive output line, and a bottom metal layer comprising a negative output line and a negative input line. In some embodiments, the negative output line and the negative input line are located in the coupler in a diagonal configuration in which the positive input line resides atop the negative output line and the positive output line resides atop the negative input line. The phase shifter 720 can also include two or more electrical loads from an inductor, a resistor, a capacitor, a transmission line, or any combination thereof. In some embodiments, the electrical loads can be variable. The top metal layer and the bottom metal layer can differentially shift an electromagnetic wave such as a radio frequency wave, among others. In some embodiments, the phase shifter 720 can include any suitable line coupler, such as the line coupler 102 of FIG. 1, which can be incorporated into a millimeter wave integrated circuit. The line coupler can output an electromagnetic wave with a phase shift.

In some embodiments, the processor 702 can vary the electrical loads of the phase shifter 720 to create the phase shift variations. For example, the processor 702 can detect a phase shift that is to be provided by the phase shifter 720. The processor 702 can also set the electrical loads of the phase shifter 720 to generate the desired phase shift. In some examples, the processor 702 can repeatedly determine the phase shift of the phase shifter 720 based on the provided electrical loads and modify the electrical loads until the desired phase shift is achieved.

It is to be understood that the block diagram of FIG. 7 is not intended to indicate that the computing device 700 is to include all of the components shown in FIG. 7. Rather, the computing device 700 can include fewer or additional components not illustrated in FIG. 7 (e.g., additional memory components, embedded controllers, modules, additional network interfaces, etc.). For example, the phase shifter 720 in the computing device 700 can include a top metal layer with two or more positive input lines and two or more positive output lines, and a bottom metal layer with two or more negative output lines and two or more negative input lines.

Furthermore, any of the functionalities of the phase shifter 720 may be partially, or entirely, implemented in hardware and/or in the processor 702. For example, the functionality may be implemented with an application specific integrated circuit, logic implemented in an embedded controller, or in logic implemented in the processor 702, among others. In some embodiments, the functionalities of the phase shifter 720 can be implemented with logic, wherein the logic, as referred to herein, can include any suitable hardware (e.g., a processor, among others), software (e.g., an application, among others), firmware, or any suitable combination of hardware, software, and firmware. Furthermore, the phase shifter 720 can also be incorporated into a power detector, a power splitter, and the like.

Figure 8:
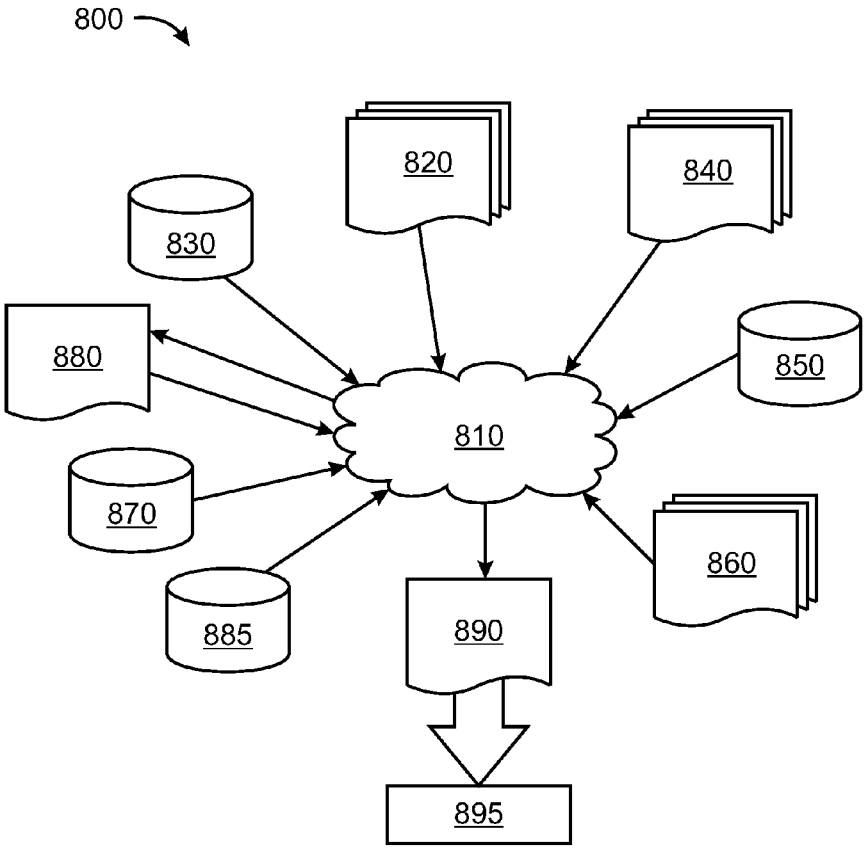
FIG. 8 is a flow diagram of a design process used in semiconductor design, manufacture, and/or testing.

FIG. 8 shows a block diagram of an exemplary design flow 800 used for example, in semiconductor IC logic design, simulation, test, layout, and manufacture. Design flow 800 includes processes, machines and/or mechanisms for processing design structures or devices to generate logically or otherwise functionally equivalent representations of the design structures and/or devices described above and shown in FIGS. 1-7. The design structures processed and/or generated by design flow 800 may be encoded on machine-readable transmission or storage media to include data and/or instructions that when executed or otherwise processed on a data processing system generate a logically, structurally, mechanically, or otherwise functionally equivalent representation of hardware components, circuits, devices, or systems. Machines include, but are not limited to, any machine used in an IC design process, such as designing, manufacturing, or simulating a circuit, component, device, or system. For example, machines may include: lithography machines, machines and/or equipment for generating masks (e.g. e-beam writers), computers or equipment for simulating design structures, any apparatus used in the manufacturing or test process, or any machines for programming functionally equivalent representations of the design structures into any medium (e.g. a machine for programming a programmable gate array).

Design flow 800 may vary depending on the type of representation being designed. For example, a design flow 800 for building an application specific IC (ASIC) may differ from a design flow 800 for designing a standard component or from a design flow 800 for instantiating the design into a programmable array, for example a programmable gate array (PGA) or a field programmable gate array (FPGA) offered by Altera® Inc. or Xilinx® Inc.

FIG. 8 illustrates multiple such design structures including an input design structure 820 that is preferably processed by a design process 810. Design structure 820 may be a logical simulation design structure generated and processed by design process 810 to produce a logically equivalent functional representation of a hardware device. Design structure 820 may also or alternatively comprise data and/or program instructions that when processed by design process 810, generate a functional representation of the physical structure of a hardware device. Whether representing functional and/or structural design features, design structure 820 may be generated using electronic computer-aided design (ECAD) such as implemented by a core developer/designer. When encoded on a machine-readable data transmission, gate array, or storage medium, design structure 820 may be accessed and processed by one or more hardware and/or software modules within design process 810 to simulate or otherwise functionally represent an electronic component, circuit, electronic or logic module, apparatus, device, or system such as those shown in FIGS. 1-7. As such, design structure 820 may comprise files or other data structures including human and/or machine-readable source code, compiled structures, and computer executable code structures that when processed by a design or simulation data processing system, functionally simulate or otherwise represent circuits or other levels of hardware logic design. Such data structures may include hardware-description language (HDL) design entities or other data structures conforming to and/or compatible with lower-level HDL design languages such as Verilog and VHDL, and/or higher level design languages such as C or C++.

Design process 810 preferably employs and incorporates hardware and/or software modules for synthesizing, translating, or otherwise processing a design/simulation functional equivalent of the components, circuits, devices, or logic structures shown in FIGS. 1-7 to generate a Netlist 880 which may contain design structures such as design structure 820. Netlist 880 may comprise, for example, compiled or otherwise processed data structures representing a list of wires, discrete components, logic gates, control circuits, I/O devices, models, etc. that describes the connections to other elements and circuits in an integrated circuit design. Netlist 880 may be synthesized using an iterative process in which netlist 880 is resynthesized one or more times depending on design specifications and parameters for the device. As with other design structure types described herein, netlist 880 may be recorded on a machine-readable data storage medium or programmed into a programmable gate array. The medium may be a nonvolatile storage medium such as a magnetic or optical disk drive, a programmable gate array, a compact flash, or other flash memory. Additionally, or in the alternative, the medium may be a system or cache memory, buffer space, or electrically or optically conductive devices and materials on which data packets may be transmitted and intermediately stored via the Internet, or other networking suitable means.

Design process 810 may include hardware and software modules for processing a variety of input data structure types including Netlist 880. Such data structure types may reside, for example, within library elements 830 and include a set of commonly used elements, circuits, and devices, including models, layouts, and symbolic representations, for a given manufacturing technology (e.g., different technology nodes, 32 nm, 45 nm, 50 nm, etc.). The data structure types may further include design specifications 840, characterization data 850, verification data 860, design rules 870, and test data files 885 which may include input test patterns, output test results, and other testing information. Design process 810 may further include, for example, standard mechanical design processes such as stress analysis, thermal analysis, mechanical event simulation, process simulation for operations such as casting, molding, and die press forming, etc. One of ordinary skill in the art of mechanical design can appreciate the extent of possible mechanical design tools and applications used in design process 810 without deviating from the scope and spirit of the invention. Design process 810 may also include modules for performing standard circuit design processes such as timing analysis, verification, design rule checking, place and route operations, etc.

Design process 810 employs and incorporates logic and physical design tools such as HDL compilers and simulation model build tools to process design structure 820 together with some or all of the depicted supporting data structures along with any additional mechanical design or data (if applicable), to generate a second design structure 890. Design structure 890 resides on a storage medium or programmable gate array in a data format used for the exchange of data of mechanical devices and structures (e.g. information stored in a IGES, DXF, Parasolid XT, JT, DRG, or any other suitable format for storing or rendering such mechanical design structures). Similar to design structure 820, design structure 890 preferably comprises one or more files, data structures, or other computer-encoded data or instructions that reside on transmission or data storage media and that when processed by an ECAD system generate a logically or otherwise functionally equivalent form of one or more of the embodiments of the invention shown in FIGS. 1-7. In one embodiment, design structure 890 may comprise a compiled, executable HDL simulation model that functionally simulates the devices shown in FIGS. 1 and 2B.

Design structure 890 may also employ a data format used for the exchange of layout data of integrated circuits and/or symbolic data format (e.g. information stored in a GDSII (GDS2), GL1, OASIS, map files, or any other suitable format for storing such design data structures). Design structure 890 may comprise information such as, for example, symbolic data, map files, test data files, design content files, manufacturing data, layout parameters, wires, levels of metal, vias, shapes, data for routing through the manufacturing line, and any other data required by a manufacturer or other designer/developer to produce a device or structure as described above and shown in FIGS. 1-7. Design structure 890 may then proceed to a stage 895 where, for example, design structure 890: proceeds to tape-out, is released to manufacturing, is released to a mask house, is sent to another design house, is sent back to the customer, etc.

What is claimed is:

1. A system for shifting electric signals comprising:

a differential coupled line coupler comprising:

a ground metal layer;

a top metal layer comprising a positive input line and a positive output line; and a bottom metal layer comprising a negative output line and a negative input line, the negative output line and the negative input line to be located in the coupler in a diagonal configuration in which the positive input line resides atop the negative output line and the positive output line resides atop the negative input line, wherein the input lines comprise metal lines with an input port on a first side and a through port on a second side, and wherein the output lines comprise metal lines with a coupled port on a first side and an output port on a second side, the input lines to be connected to a through differential load, and the output lines to be connected to a coupled differential load, wherein the through differential load and the coupled differential load each comprise an inductor, a capacitor, a transmission line, a resistor, or any combination thereof, and wherein an electric signal of the output lines in relation to an electric signal of the input lines is to be shifted.

2. The system of claim 1, wherein the top metal layer comprises a first material and the bottom metal layer comprises a second material, and the first material has a different sheet resistance, different metal width, different metal height, and different metal lateral spacing than the second material.

3. The system of claim 1, wherein the through differential load and the coupled differential load provide variable loads.

4. The system of claim 1, wherein the differential coupled line coupler is to shift electric signals in millimeter wave in frequencies above 30 GHz based on the through differential load, the coupled differential load, and the differential coupled line coupler.

5. The system of claim 1, wherein the ground metal layer is to be a solid plane.

6. The system of claim 1, wherein the ground metal layer is to be a striped plane.

7. The system of claim 1, wherein the positive and negative input lines and the positive and negative output lines are folded laterally or twisted in an angle, such that the input port and the through port of the input lines are on the same side or another orientation to each other, and the output port and the coupled port of the output lines are on the same side or another orientation to each other.

8. The system of claim 1, wherein the top metal layer comprises two or more positive input lines and two or more positive output lines, and the bottom metal layer comprises two or more negative output lines and two or more negative input lines.

9. The system of claim 8, wherein multiple loads are connected to the differential line coupler, each of the through differential loads connected separately to a differential pair of input lines, each of the coupled differential loads connected separately to a differential pair of output lines, wherein the through loads have either the same or different control voltages for each load, the coupled loads have either the same or different control voltages for each load.

10. The system of claim 8, wherein the through differential load is connected to the positive and negative input lines, and the coupled differential load is connected to the positive and negative output lines.

11. The system of claim 8, wherein the multiple positive and negative input lines and multiple positive and negative output lines are folded laterally or twisted in another angle, such that the multiple input ports and the multiple through ports of the multiple input lines are on the same side or any other orientation to each other, and the multiple output ports and the multiple coupled ports of the multiple output lines are on the same side or another orientation to each other.

12. The system of claim 1, wherein the differential coupler comprises two or more bottom layers and two or more top layers, each top layer to reside proximate a lower bottom layer and each top layer comprising a positive input line and a positive output line and each of the lower bottom layers comprising a negative output line and a negative input line.

13. The system of claim 12, wherein multiple loads are connected to the differential line coupler, each of the through differential loads connected separately to a differential pair of input lines, each of the coupled differential loads connected separately to a differential pair of output lines, wherein the through loads are either the same or different control voltages for each load, and the coupled loads are either the same or different control voltages for each load.

14. The system of claim 12, wherein the through differential load is connected to the positive and negative input lines, and the coupled differential load is connected to the positive and negative output lines.

15. The system of claim 12, wherein the multiple positive and negative input lines and multiple positive and negative output lines are folded laterally or twisted in another angle, such that the multiple input ports and the multiple through ports of the multiple input lines are on the same side or another orientation to each other, and the multiple output ports and the multiple coupled ports of the multiple output lines are on the same side or another orientation to each other.

16. The system of claim 12, wherein each of the top metal layers comprises two or more positive input lines and two or more positive output lines, and each of the bottom metal layers comprises two or more negative output lines and two or more negative input lines.

17. A method for shifting electric signals comprising:

differentially transmitting an electric signal to a positive input line and a negative input line, wherein the positive input line and the negative input line reside in a diagonal configuration in different layers of a differential line coupler;

setting variable loads to perform a predetermined phase shift of the electric signal; and outputting a resulting electric signal from a positive output line and a negative output line, wherein the positive output line and the negative output line reside in a diagonal configuration in different layers of the line coupler.

18. The method of claim 17, wherein the top metal layer comprises a first material and the bottom metal layer comprises a second material, and the first material has a different sheet resistance, different metal width, different metal height, and different metal lateral spacing than the second material.

19. The method of claim 18, wherein the top metal layer comprises the positive input line and the positive output line and the bottom metal layer comprises the negative input line and the negative output line.

20. A system for shifting electric signals comprising:

a ground metal layer, the ground metal layer to be a solid plane or a striped plane;

a top metal layer comprising a positive input line and a positive output line; and a bottom metal layer comprising a negative output line and a negative input line, the negative output line and the negative input line to be located in the coupler in a diagonal configuration in which the positive input line resides atop the negative output line and the positive output line resides atop the negative input line, and wherein the top metal layer and the bottom metal layer are to differentially shift an electric signal based on at least two received loads, the at least two loads residing in an inductor, a capacitor, a transmission line, a resistor, or any combination thereof, and wherein an electric signal of the output lines in relation to an electric signal of the input lines is to be shifted.

* * * * *